US005997209A

United States Patent [19]

Sachs

[11] Patent Number: 5,997,209

[45] Date of Patent: Dec. 7, 1999

[54] DECKING CLIP

[75] Inventor: Richard James Sachs, Brisbane, Australia

[73] Assignee: Alchemy Nominees Pty. Ltd., Teneriffe, Australia

[21] Appl. No.: 08/715,513

[22] PCT Filed: Mar. 14, 1995

[86] PCT No.: PCT/AU95/00131

§ 371 Date: Sep. 18, 1996

§ 102(e) Date: Sep. 18, 1996

[87] PCT Pub. No.: WO95/25856

PCT Pub. Date: Sep. 28, 1995

[30] Foreign Application Priority Data

Mar. 18, 1994 [AU] Australia ..... PM4570

[51] Int. Cl.[6] ..... F16B 5/00

[52] U.S. Cl. ..... 403/388; 403/384; 403/400; 52/715; 52/480

[58] Field of Search ..... 403/388, 384, 403/400, 396, 403, 394, 405.1, 389, 283; 52/718, 712, 480, 489.1, 489.2, 585.1, 586.1

[56] References Cited

U.S. PATENT DOCUMENTS

| | | | |
|---|---|---|---|
| 3,031,725 | 5/1962 | Omholt | 52/480 X |
| 3,237,360 | 3/1966 | Mills | 52/489.2 |
| 3,619,963 | 11/1971 | Omholt | 52/480 X |
| 3,669,480 | 6/1972 | Fugate | 403/384 |
| 3,713,264 | 1/1973 | Morgan, Jr. . | |
| 4,313,688 | 2/1982 | Daniels . | |
| 4,620,403 | 11/1986 | Field | 52/715 X |
| 4,844,651 | 7/1989 | Partridge . | |
| 4,925,141 | 5/1990 | Classen . | |
| 5,027,573 | 7/1991 | Commins et al. | 52/715 X |

FOREIGN PATENT DOCUMENTS

| | | | |
|---|---|---|---|
| 1243/26 | of 1926 | Australia | 403/400 |
| 4757/38 B | 10/1939 | Australia . | |
| 56375/94 | 9/1994 | Australia . | |
| 177959 | 4/1986 | European Pat. Off. . | |
| 1418631 | 10/1965 | France . | |
| 564596 | 11/1932 | Germany | 52/489.2 |
| 2814095 | 10/1979 | Germany | 403/400 |
| 3004383 | 8/1981 | Germany . | |
| 16930 | of 1887 | United Kingdom . | |
| 1358863 | 7/1974 | United Kingdom . | |
| 1567008 | 5/1980 | United Kingdom . | |
| 2172078 | 9/1986 | United Kingdom . | |

*Primary Examiner*—Harry C. Kim

*Attorney, Agent, or Firm*—Merchant, Gould, Smith, Edell, Welter & Schmidt, P.A.

[57] ABSTRACT

A fastener for timber decking, fences, pallets and the like comprises a joist attachment plate (11), with one or more fastening apertures (12) therein, one or more spacing flanges (13) locatable between joists (20) and planks (30), a plank spacer (14) extending between adjacent planks (30) and axially aligned plank engaging teeth (17, 18) extending from opposed sides of the plank spacer (14) to engage respective side surfaces of adjacent planks (30).

9 Claims, 5 Drawing Sheets

DECKING CLIP

FIELD OF THE INVENTION

This invention pertains to an attachment bracket and, more specifically, involves, a fastener for spacing and fastening timber planks to a transverse support such as a joist, purlin or like support members.

BACKGROUND ART

Timber decks or fences comprising two or more timber joists spanned by a plurality of parallel planks nailed to the joists are typically constructed by driving nails down through the exposed face surface of the planks into the joists. This method is undesirable for several reasons. With hammering, it is easy to miss and hit the plank thus denting or marking it.

Flat head nails hold well but can be seen and detract from the aesthetic appearance of the deck and the nail head will often discolour the area around it.

Bullet head nails are not as displeasing in appearance but as the head is usually countersunk, water can be retained in the nail hole which leads to rot and rust.

Nails of all types can work up such that the nail head is above the plank surface and cause a safety hazard.

A particular problem associated with timber decking is that water can get into the joint between the plank and joist and causes rot.

One alternative which produces a more aesthetic surface is to countersink a wood screw and to plug the hole above the screw with a plug of wood. This method is expensive and time consuming; the plugs work out in time and the screw holes fill with water.

Therefore, it is desirable to have a fastening device which overcomes the shortcomings of the prior art timber fastenings and which attaches planks to a deck with an unmarked upper surface, especially if it spaces the planks from the joist.

It is further desirable that the fastening device provides a means for spacing the planks from one another.

U.S. Pat. No. 4,965,980 (Leavens) discloses an anchoring bracket for use in attaching substantially parallel planks to a generally transverse member or joist and in spacing the planks and generally comprises a spacer side and a joist attachment side.

The spacer side has a spacing portion for placement on the top of the joist for spacing a board from the joist and an extended portion attached to the spacing portion for extending over the edge of the joist. A plank spacer tab, affixed to the spacer side, projects generally perpendicularly upward therefrom for positioning directly adjacent a plank for controlling the spacing thereof.

The joist attachment side includes an attachment portion disposed generally perpendicular to the spacer side for attachment to the side of the joist and an angled portion connecting the attachment portion to the outer end of the extended portion. The angled portion includes holes for receiving a fastener for fastening a plank to the bracket.

An alternate embodiment includes a plurality of plank spacer tabs affixed at intervals to the spacer side; each for positioning directly adjacent a plank for controlling the spacing of a plurality of planks.

While the deck bracket of Leaven has certain advantages over the prior art, it also has a number of disadvantages. Of these, the major disadvantage is that it requires the operator to have access to a region below the deck to enable the fasteners to be inserted upwardly through the holes in the angled portion and then driven into the deck planks. Moreover, the plank spacer tabs are at fixed modular distances and cannot easily accommodate variations in the width of the deck planks.

U.S. Pat. No. 4,925,141 (Classen) describes a deck clip having a pair of spaced joist attachment plates to attach the clip on either side of a joist. Bridging the spaced attachment plates is an upright planar member having oppositely directed pointed tangs spaced on either side of the upright planar member. The planar member optionally has projections which act as spacers between adjacent planks.

While generally effective for its purpose, this clip does not include spacing flanges to elevate the planks above the surface of the joist to resist rot. More importantly however, the non aligned axes of the plank penetrating tangs makes these clips difficult to fix without skewing.

Other embodiments of the Classen clip have misaligned plank penetrating tangs and do not possess spacing flanges to separate the planks from the joists.

U.S. Pat. No. 5,027,573 describes a connector bracket for use in construction of timber planked decks and the like.

This bracket is attachable to an edge of a plank and includes a projecting lip which engages under the edge of an adjacent plank which has been skew nailed through its edge to a joist to provide a hidden fastening means.

The major disadvantage of this type of fastening is that it is indirectly connected to an adjacent plank. Planks which are skew nailed at their edges are prone to splitting and this releases the indirect connection with the adjacent plank allowing substantial relative movement between the planks.

U.S. Pat. No. 4,844,651 (Partridge) describes a decking clip which attaches to the edge of a decking plank and also on the undersurface thereof leaving an apertured lip projecting adjacent the lower surface of the plank.

These clips must be pre-attached to a deck plank on both edges thereof with clips along one edge aligned with spaced joists and clips along the opposite edge misaligned with the joists.

Planks are secured to the joists by engaging the misaligned lips under a plank fixed to the joists and securing the opposite side of the plank to the joists with fasteners extending through the apertured lips.

Although effective for their purpose, these clips do not include integral plank spacers, are expensive in that two rows of clips are required and otherwise are time consuming to attach.

SUMMARY OF THE INVENTION

It is an object of the present invention to provide a simple fastener which can simply and easily locate and fix deck planks or the like to a joist.

It is a preferred object to provide a fastener which is relatively inexpensive to produce.

Other preferred objects will become apparent from the following description.

In one aspect, the present invention resides in a fastener for use in attaching at least two parallel planks generally transversely to a support member, said support member having a top surface for receiving the planks and at least one side surface substantially perpendicular thereto, said fastener including;

a joist attachment plate for attachment to a side surface of said support member;

a plank spacer associated with the joist attachment plate, said plank spacer in use extending above the top surface of the support member; and axially aligned tapered plank engaging teeth extending from opposed sides of the plank spacer substantially parallel to said joist attachment plate to engage respective side surfaces of adjacent planks supported on the top surface of the support member.

Preferably, at least one spacer flange extends from the joist attachment plate substantially perpendicular thereto in use to extend between the support member and adjacent planks supported thereon.

Suitably, the joist attachment plate has at least one aperture to receive a fixing element to secure the plate to the side surface of the support member. One or more teeth or spikes formed integrally with the joist attachment plate may extend perpendicular to the plate for engagement with the side surface of the is support member.

If required, the plank spacer may be an upright projection formed integrally with the joist attachment plate, the distance between the opposed sides of the projection defining in use the spacing between the adjacent planks. The projection may have an upper portion extending substantially perpendicular to a lower portion thereof, said upper portion including integrally formed plank engaging teeth extending from opposed sides thereof.

If required the plank engaging teeth may include reinforcing ribs formed therein.

Preferably the fastener is corrosion resistant metal.

Alternatively the fastener may comprise a joist attachment plate and spacer flange formed integrally from plastics material.

The fastener may include a plastics plank spacer formed integrally with or separate from said joist attachment plate.

Suitably the plank spacer includes an aperture adjacent a lower end to receive a metal fastening element therethrough and an aperture adjacent an upper end to receive a metal plank engagement member therethrough, said plank engagement member having axially aligned plank engaging teeth.

According to another aspect of the invention there is provided a plank fastening system comprising fasteners according to the first aspect of the invention for attachment of adjacent sides of planks to support members; and, end fastening members for attachment of the side of a plank to end portions of adjacent support members, said edge fastening members including an apertured joist end engaging plate, at least one plate side engaging tooth associated with said joist end engaging plate, said at least one plank side engaging tooth being movable between a retracted position and a plank engaging position, and a spacer flange having at least one upright plank engaging tooth.

In a further aspect, the present invention resides in a method of attaching parallel planks to a generally transversely oriented support member having a top surface for receiving said planks and side surface substantially perpendicular thereto, the method incorporating the steps of:

a) securing a joist attachment plate of a first fastener (as hereinbefore described) against the side face of the support member;

b) engaging one side face of a plank with a plank engaging tooth and with the spacer flange;

c) engaging a plank engaging tooth and spacer flange of a second fastener with the opposed side face of the plank and attaching the joist attachment plate of said second fastener to the side face of the support member;

d) engaging one side face of a second plank with a plank engaging tooth and spacer means of the second fastener; and e) repeating steps (c) and (d) to progressively attach planks to the support member.

BRIEF DESCRIPTION OF DRAWINGS

To enable the invention to be fully understood and put into practical effect, preferred embodiments will now be described with reference to the accompanying drawings, in which.

DETAILED DESCRIPTION OF DRAWINGS

Figure 1:
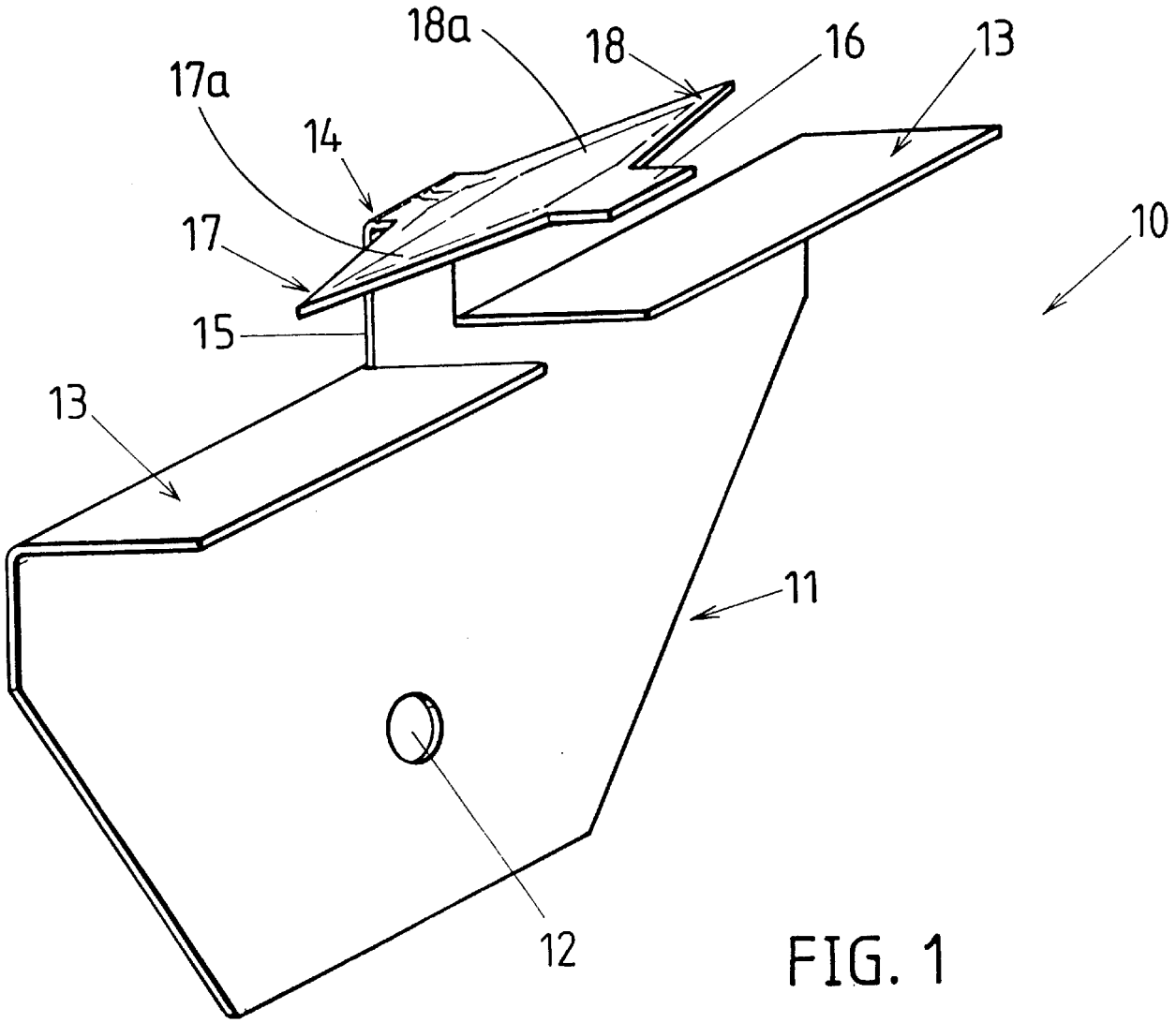
FIG. 1 is a perspective view of a fastener according to one aspect of the invention.

Referring to FIG. 1, the fastener 10 has a joist attachment plate 11 with an aperture 12 to receive a fastener such as a nail or wood screw, to fix the plate 11 to a joist.

A pair of spacer flanges 13 extend perpendicularly from the top of the attachment plate 11.

A spacer finger 14 has a lower upright portion 15 integral with the joist attachment plate 11 and a tab portion 16, which is provided with a pair of opposed tangs or spikes 17, 18 parallel to, but spaced above, the spacer flanges 13. Tangs 17, 18 are formed with tapered reinforcing ribs 17*a*, 16*a*.

Figure 2:
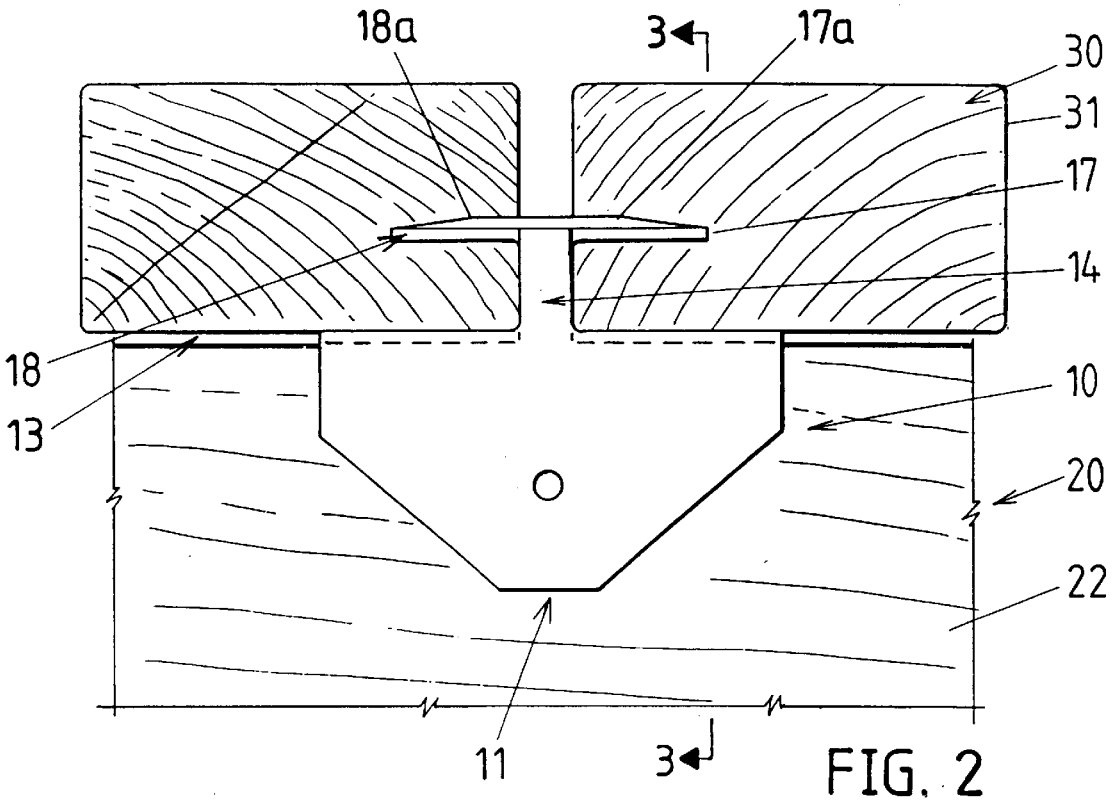
FIG. 2 is a sectional side view of the fastener of FIG. 1 in use.
Figure 3:
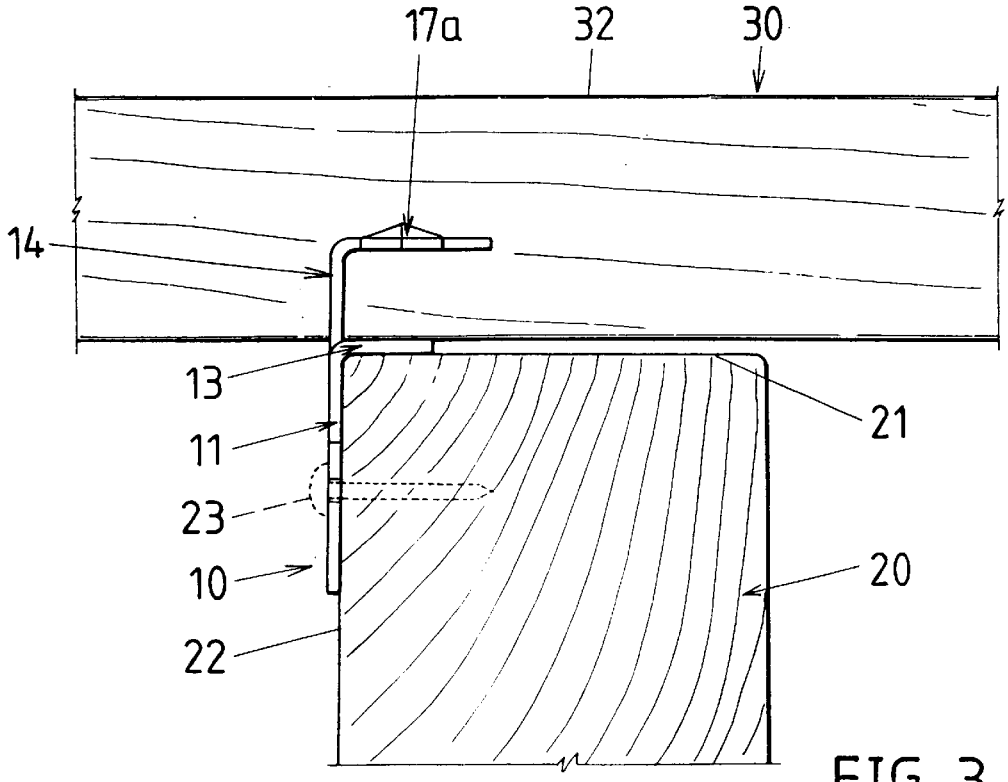
FIG. 3 is a sectional end view of the fastener of FIG. 2 taken on line A—A in FIG. 2.

Referring now to FIGS. 2 and 3, the fastener 10 is located on a joist 20, with the spacer flanges 13 nesting on the top surface 21 of the joist 20 and the joist attachment plate 11 against a side surface 22 of the joist 20. A screw or nail 23 fixes the joist attachment plate 11 to the joist 20.

As shown, each tang or spike 17, 18 is engaged in a side face 31 of a respective plank 30 laid transversely over the joist 20 (and spacer flanges 13), the spacer finger 14 defining the distance between adjacent boards 30.

In use, the fastener 10 is first fixed to the joist 20 at a predetermined position and the side face 31 of a plank 30 is engaged with a tang or spike 17, 18.

A second plank 30*a* is urged into engagement with the exposed tang or spike 17, 18 of the fastener 10. A tang or spike 17, 18 of a second fastener 10 is then engaged with the other side face 31 of the second board 30*a* before the second fastener 10 is fixed to the joist 20.

The planks 30 are progressively laid on the joist 20 and secured by the fasteners 10. As the spacer fingers 14 and tangs or spikes 17, 18 are below the top surfaces 32 of adjacent planks 30, 30*a*, the fixing of the planks 30 to the joists 20 is concealed and the spacer flanges assist in preventing rot occurring between the junction of the planks 30 and joists 20.

With this embodiment, the installer can kneel on the planks and/or joists and does not have to reach below floor surface to fix the planks in position.

The attachment plates 11 and spacer flanges 13 may have integrally formed fasteners in the form of punched teeth perpendicular to the plates to temporarily locate the fasteners 10 on the joist 20 before they are secured more permanently by the fasteners 23.

While the spacer fingers 14 have been shown in an inverted L-shape, they may be co-planar with the joist attachment plates 11 (and incorporate ribbing) and the tangs or spikes 17, 16 may extend therefrom.

Similarly, tab portion 16 may be bent upwardly or downwardly to form a spacing member alone or in addition to upright portion 15.

Figure 5:
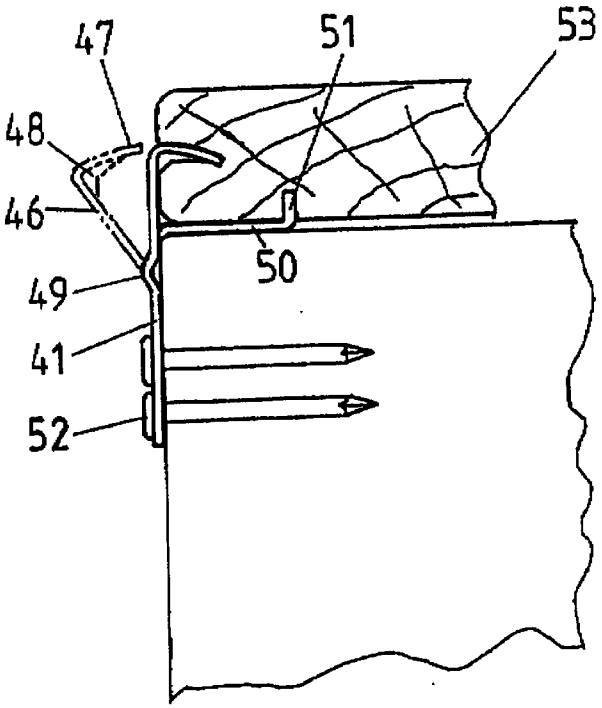
FIGS. 4 to 6 show an alternative embodiment of a fastener according to the invention.
Figure 4:
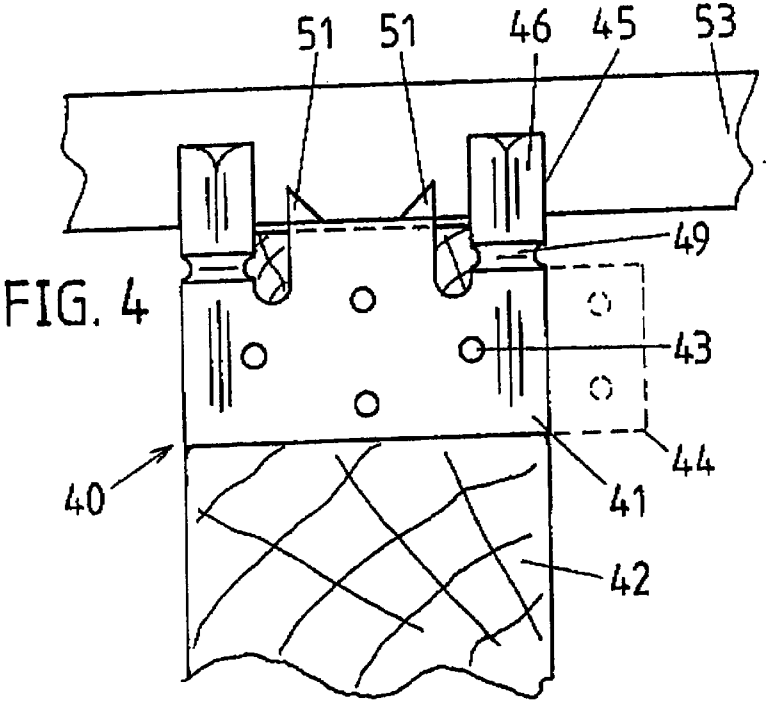
Figure 6:
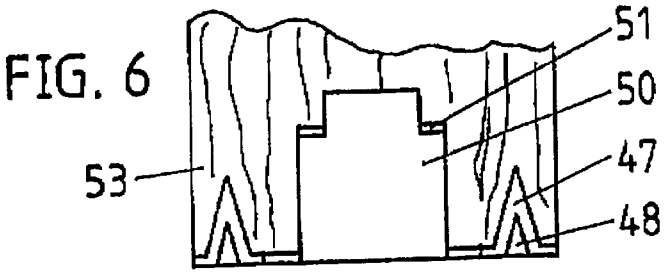

FIGS 4 to 6 show an alternative embodiment of the invention.

In FIG. 4 there is shown an end elevation of a fastener 40 having a joist attachment plate 41 adapted for fixing on the end of a joist 42. Plate 41 is provided with a plurality of apertures 43 to enable the fastener 40 to be secured by nails, screws or the like. Optionally, joist attachment plate 41 may include one or more apertured side attachment plates 44 (shown in phantom) to secure the fastener at the side or sides of joist 42 in addition to the end of the joist.

As shown in FIGS. 5 and 6 which respectively represent side and top views of the arrangement of FIG. 4, there are provided a pair of engagement members 45 in the form of an upright arm 46 and an arcuate pointed tang 47 having a tapered reinforcing rib 48.

Engagement members 45 have a fold line or crease 49 at the base of upright arm 46 and initially arms 46 are in a rearwardly bent position as shown in phantom in FIG. 5.

Between arms 46 is an inwardly directed spacer flange 50 with a pair of spaced upright pointed locating tangs 51.

The embodiment of FIGS. 4 to 6 is used to start or finish, say, a timber deck construction or otherwise to provide a means for connecting the junction of a plank and joist at the end of a joist.

In use, the joist attachment plate 41 is secured to the end of a joist 42 by nails 52 extending through apertures 43. Tab 50 rests on the top surface of joist 42 and initially, the engagement members 45 are in a retracted position.

A plank 53 is then positioned over the fastener 40 and is tapped downwardly to engage locating tangs 51 into the undersurface of plank 53 which rests on spacer flange 50. With plank 53 supported against transverse movement, retracted engagement member 45 is hammered home to permit the pointed tang 47 to penetrate the edge of plank 53 in an arcuate direction.

Figure 7:
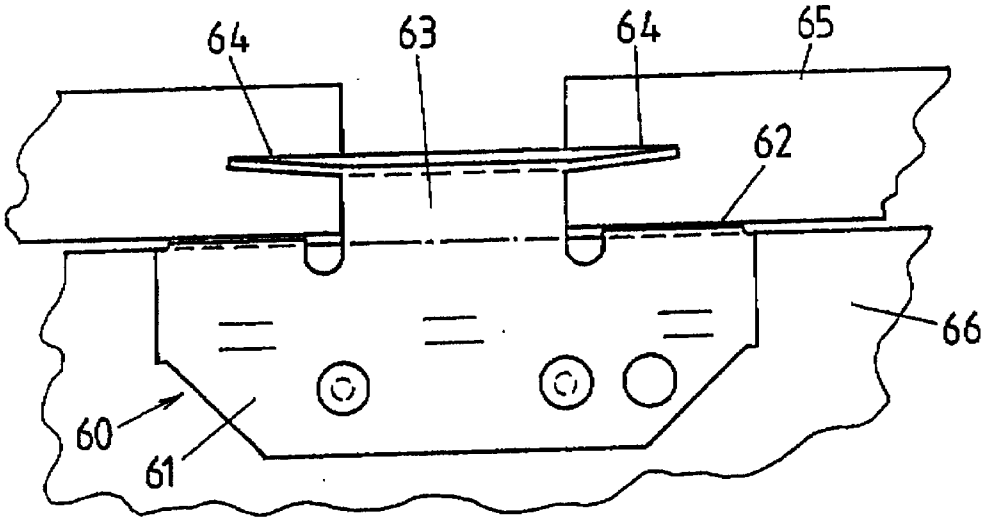
FIGS. 7 and 8 show further embodiment of fasteners.

FIG. 7 shows an adaptation of the fastener of FIGS. 1 to 3 for wider spaces between adjacent planks for example in fence construction or for timber pallets.

The fastener 60 has an apertured joist attachment plate 61, spacer flanges 62, a spacer finger 63 and opposed pointed tangs 64 in a manner similar to that of FIGS. 1 to 3 except that it provides a broader spacing for planks 65 supported on joist 66.

Figure 8:
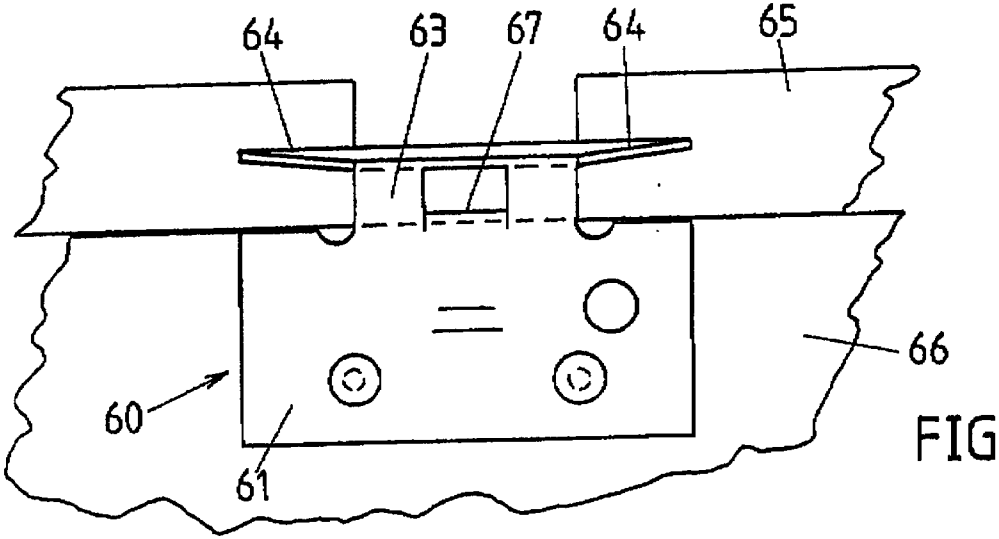

FIG. 8 shows a variation on the embodiment of FIG. 7 adapted for use with timber pallets and for the sake of clarity the same reference numerals are employed in FIG. 8.

In this embodiment, the spacer flanges have been deleted to improve frictional engagement between the planks 65 and joist 66 although spacer flanges employing upwardly and downwardly extending pointed tangs (not shown) could be employed for this purpose.

A perforated tab 67 extending laterally from spacer finger 63 provides a locating and alignment means which rests on the upper surface of joist 66 while the fastener is secured to the joist.

Figure 10:
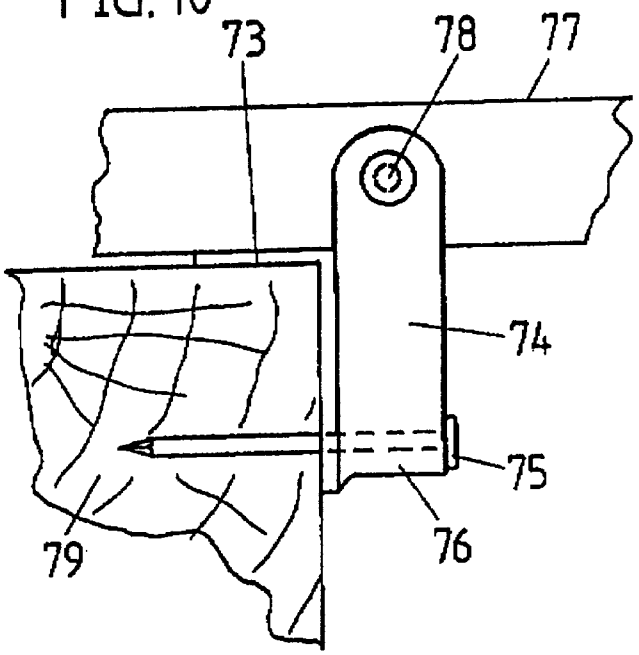
FIGS. 9 to 11 show yet another embodiment of a fastener according to the invention.
Figure 9:
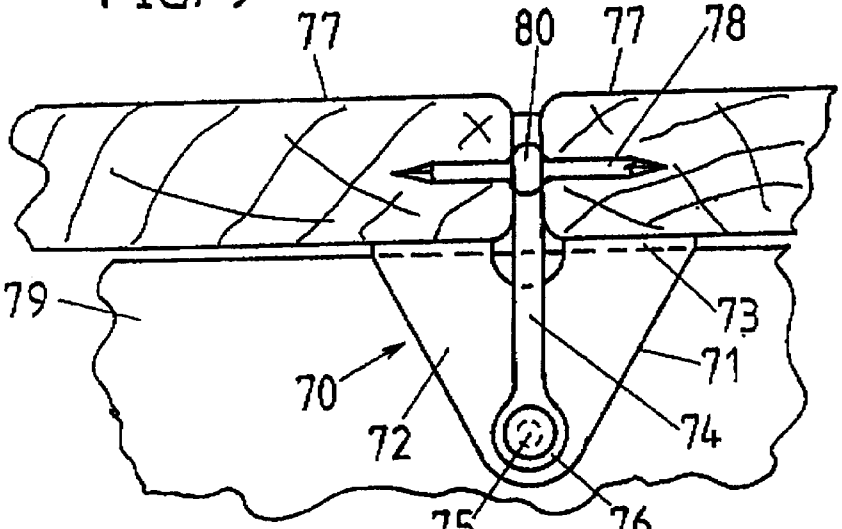
Figure 11:
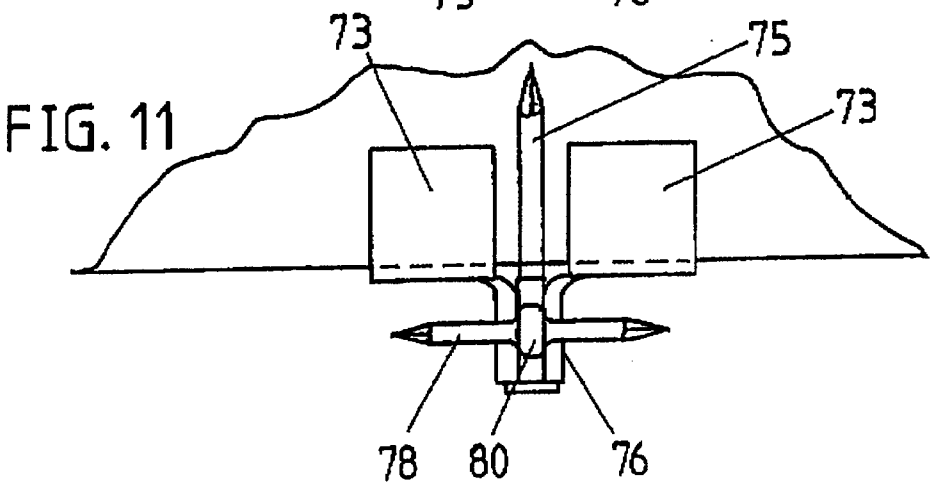

FIG. 9 to 11 show yet another embodiment of the invention.

In FIGS. 9 to 11 the fastener 70 comprises a joist engaging member 71 having an upright wall 72 and transverse spacer flanges 73. Joist engaging member 71 may be of metal or plastics.

A connecting arm 74 of plastics or metal may be formed separately or integrally with member 71 and includes a captive fastener in the form of a flat headed nail 75 at its lower end 76.

The upper end of arm 74 is shaped or dimensioned to form a spacer between adjacent planks 77 and includes a free or captive steel pin 78 or the like sharpened at both ends.

In use, the spacer flanges are located on the upper surface of joist or bearer 79 and nail 75 is used to secure the fastener 70 to the joist 79. If required the steel pin or the like 78 may include an enlargement 80 intermediate its ends to act as a spacer for planks 77.

Planks 77 are then secured to fastener 70 on either side of connecting arm 74 with the sharpened shanks of pin 78 embedded in planks 77.

Successive adjacent planks are secured in a similar manner to form planked decking or the like, and if required, the edge plank of the deck may be secured by the fastener of FIGS. 4 to 6.

It will be found in practice that fasteners according to the invention are equally as effective in hard timbers as well as soft timbers with a minimal risk of splitting the timber when attached thereto.

Various changes and modifications may be made to the embodiments described and illustrated without departing from the present invention. For example, fasteners according to the invention are readily adapted to permit attachment of timber planks to steel joists by self tapping screws, bolts or the like extending through the joist attachment plate.

We claim:

1. A fastener for attaching at least two parallel planks generally transversely to a support member, the planks having respective side surfaces, said support member having a top surface for receiving the planks and at least one side surface substantially perpendicular thereto, said fastener comprising:

a joist attachment plate for attachment to the side surface of said support member, said joist attachment plate forming a first plane;

a plank spacer adapted to extend beyond the top surface of the support member, said plank spacer comprising an upright projection formed integrally with the joist attachment plate, the upright projection having an upper portion extending substantially perpendicular to a lower portion thereof;

axially aligned tapered plank engaging teeth extending from opposed sides of the upper portion of the upright projection in a second plane substantially perpendicular to the first plane of said joist attachment plate to engage the respective side surfaces of adjacent planks supported on the top surface of the support member; and at least one spacer flange extending from the joist attachment plate substantially perpendicular thereto in use to extend between the support member and adjacent planks supported thereon.

2. A fastener as claimed in claim 1 wherein the joist attachment plate has at least one aperture for receiving a fixing element to secure the plate to the side surface of the support member.

3. A fastener as claimed in claim 1 further comprising one or more teeth or spikes formed integrally with the joist attachment plate and extending substantially perpendicular to the plate for engagement with the side surface of the support member.

4. A fastener as claimed in claim 1 wherein the fastener is formed from plastics material.

5. A fastener as claimed in claim 1 wherein a distance between opposed sides of the upright projection defines in use a spacing between the adjacent planks.

6. A fastener as claimed in claim 1 wherein the plank engaging teeth include reinforcing ribs formed therein.

7. A fastener as claimed in claim 1 wherein the fastener is formed from corrosion resistant metal.

8. A plank fastening system comprising fasteners according to claim 1 for attachment of adjacent sides of planks to support members; and end fastening members for attachment of the side of a plank to end portions of adjacent support members, said end fastening members including an apertured joist end engaging plate, at least one plate side engaging tooth associated with said joist end engaging plate, said at least one plank side engaging tooth being movable between a retracted position and a plank engaging position, and a spacer flange having at least one upright plank engaging tooth.

9. A method of attaching parallel planks to a generally transversely oriented support member having a top surface for receiving said planks and at least one side surface substantially perpendicular thereto, the method utilising a plurality of fasteners, including a first and second fastener, each fastener comprising a joist attachment plate for attachment to the side surface of the support member; a plank spacer associated with the joist attachment plate and extending beyond the top surface of the support member, axially aligned tapered plank engaging teeth extending from opposed sides of the plank spacer in a plane substantially perpendicular to the plane of said joist attachment plate, and a spacer flange extending from the joist attachment plate substantially perpendicular thereto and including the steps of:

a) securing the joist attachment plate of the first fastener against the side face of the support member;

b) engaging a first plank with a plank engaging tooth of the first fastener and with the spacer flange;

c) engaging a plank engaging tooth and spacer flange of the second fastener with an opposed side face of the first plank and attaching the joist attachment plate of said second fastener to the side face of the support member;

d) engaging a second plank with an opposed plank engaging tooth and spacer flange of the second fastener; and e) repeating steps (c) and (d) to progressively attach planks to the support member.

* * * * *